US005148554A

United States Patent [19]

Martin

[11] Patent Number: 5,148,554

[45] Date of Patent: Sep. 22, 1992

[54] VARIABLE FLUSH VALVE FOR A TOILET

[75] Inventor: Paul F. Martin, Leesburg, Fla.

[73] Assignee: Aqualogic Systems, Inc., Roswell, Ga.

[21] Appl. No.: 623,599

[22] Filed: Dec. 7, 1990

[51] Int. Cl.[5] ..... E03D 1/35

[52] U.S. Cl. ..... 4/394; 4/415

[58] Field of Search ..... 4/324, 325, 394, 415

[56] References Cited

U.S. PATENT DOCUMENTS

| | | | |
|---|---|---|---|
| 2,290,679 | 7/1942 | Edes | 4/394 |
| 2,962,727 | 12/1960 | Kanter et al. | 4/394 X |
| 3,306,313 | 5/1962 | Jenkins | 4/324 |
| 3,331,084 | 7/1967 | Wustner | 4/325 |
| 3,839,746 | 10/1974 | Kowalski | 4/325 |
| 3,921,226 | 11/1975 | Macdonald | 4/324 |
| 3,982,283 | 9/1976 | Goldring | 4/324 X |
| 4,000,526 | 1/1977 | Biela | 4/325 X |
| 4,135,263 | 1/1979 | Anderson | 4/394 X |
| 4,145,774 | 3/1979 | Sullivan | 4/325 |
| 4,155,128 | 5/1979 | Dyer | 4/394 X |
| 4,467,482 | 8/1984 | Dyer | 4/394 X |
| 4,782,537 | 11/1988 | Kinslow | 4/415 |

*Primary Examiner*—Henry J. Recla
*Assistant Examiner*—Robert M. Fetsuga
*Attorney, Agent, or Firm*—Choate, Hall & Stewart

[57] ABSTRACT

A modified flapper valve for use in a toilet tank having a flexible extension structure attached at a first end to the valve and including a second end having at least one primary attachment point and a plurality of secondary attachment points, and a float element removably attachable to the extension structure and including a plurality of grooves for receiving the primary attachment point and the secondary attachment points of the extension structure, wherein the number of secondary attachment points of the extension structure engaging the grooves of the float element determines the distance of the float element from the valve. The extension structure can include a weight, either removable from or integral with, the extension structure. The valve can be mounted within the tank by conventional arms or by closing-moment exerting arms.

8 Claims, 5 Drawing Sheets

VARIABLE FLUSH VALVE FOR A TOILET

BACKGROUND OF INVENTION

The invention relates to flushing valves for use in toilets and, more particularly, to an improved flushing valve design that can be closed after a partial flush, thus saving water.

Water is a precious commodity that must be conserved and utilized wisely. However, water is often wasted needlessly.

Toilets are designed to remove waste through a discharge of water from a holding tank. By rotating and releasing the flush handle, all the water in the holding tank is flushed through the toilet. Often, the amount of water discharged out of the holding tank exceeds the volume necessary to remove waste. Combined with the frequency of use, this excess water can become a substantial amount.

Numerous methods have been advanced to reduce the amount of water used needlessly in toilets. In particular, the use of weighted and/or float assisted flushing valves is known in the art. U.S. Pat. No. 3,921,226, issued Nov. 25, 1975, in the name of Warren E. Macdonald, shows a float cup that prematurely closes a vertical flush valve by settling upon the valve before all the water in the holding tank has been discharged. U.S. Pat. No. 4,135,263, issued Jan. 23, 1979, in the name of John K. Anderson, shows a complex float chamber apparatus which lowers itself onto a vertical flush valve and by a predetermined controlled leakage of air from the float chamber, forces the valve to close prematurely.

Not only do these designs operate primarily with the vertical flush valve rather than the more common flapper valve, but they also involve a difficult and complex retrofit of the existing valve. To the contrary, the present invention can be used with both the vertical and flapper valve configurations, is easy and practical to install, and is adjustable to control the volume of water "saved."

SUMMARY OF INVENTION

The valve of the invention combines a weight element and a float element which provide the valve with a slightly positive buoyancy when the float is totally submerged. These elements are included in a structure that extends substantially perpendicularly from the valve seat such that the float is positioned a selected distance from the valve seat. The structure is preferably attached to the valve seat along an axis parallel to the valve's axis of rotation and directly opposite from the location of the axis of rotation for maximum mechanical advantage. The structure contains a thin portion at the joint with the valve seat allowing the structure to rotate about this joint.

The weight element and its operational function can be replaced with a modification to the flapper valve mounting apparatus having a flexible section that restricts the rotation of the valve and imposes a closing moment on the valve.

PREFERRED EMBODIMENT

Figure 1:
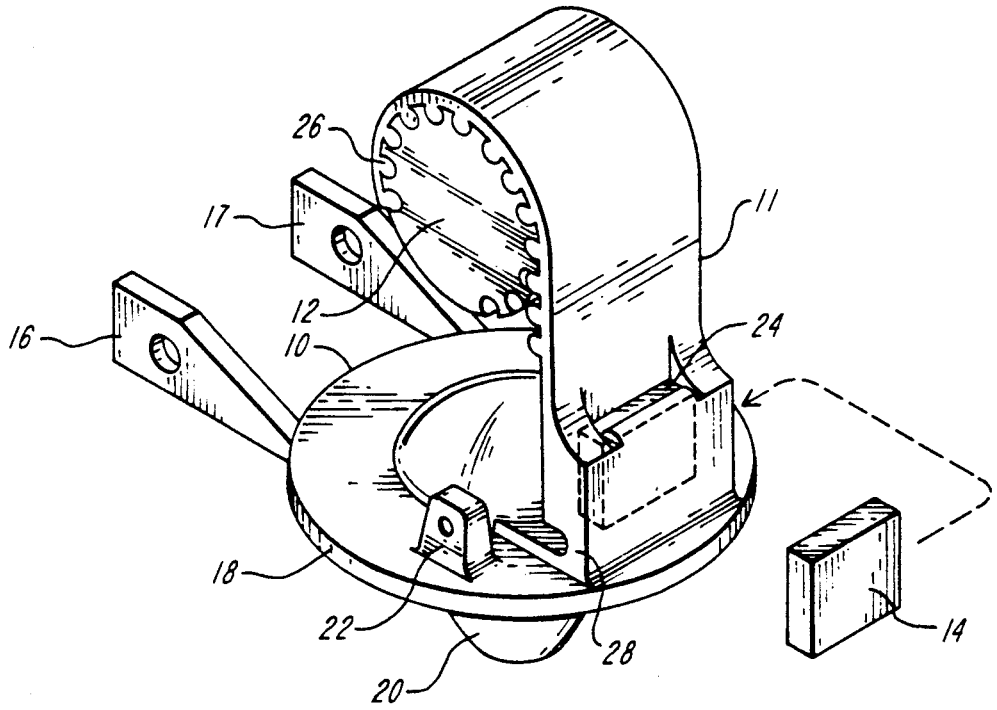
FIG. 1 is a perspective view of a flapper valve embodying the present invention.
Figure 2:
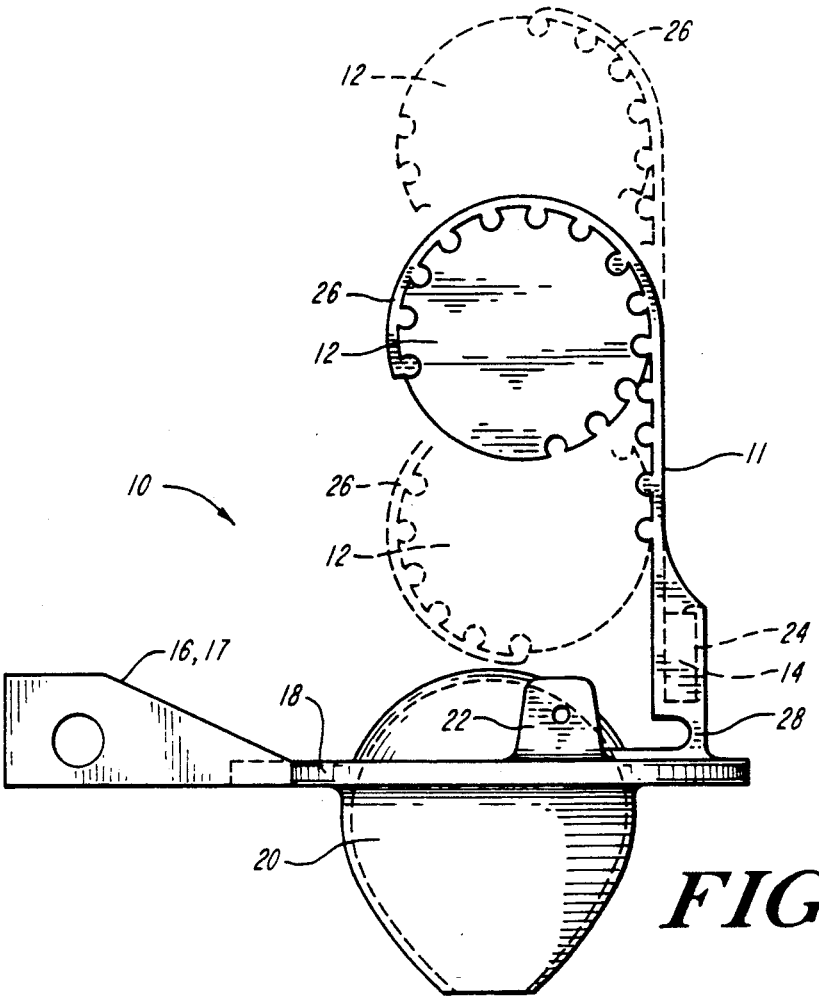
FIG. 2 is a side view of the flapper valve of FIG. 1.
Figure 4:
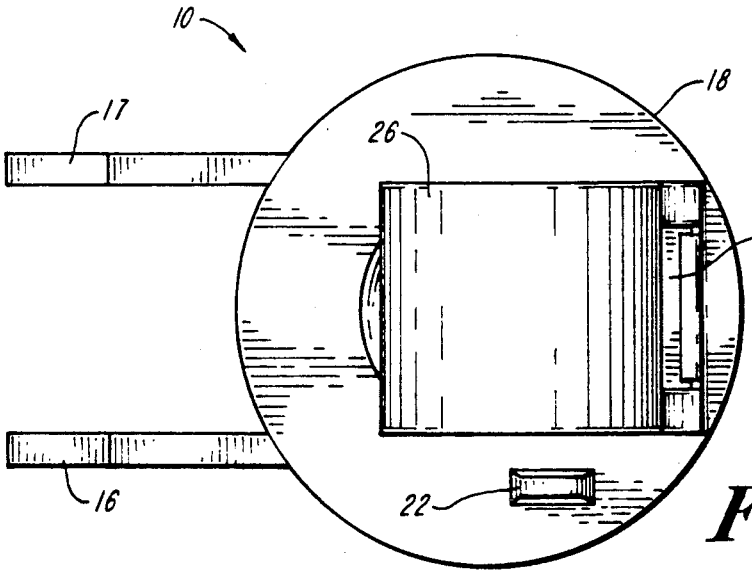
FIG. 4 is a top view of the flapper valve of FIG. 2.
Figure 3:
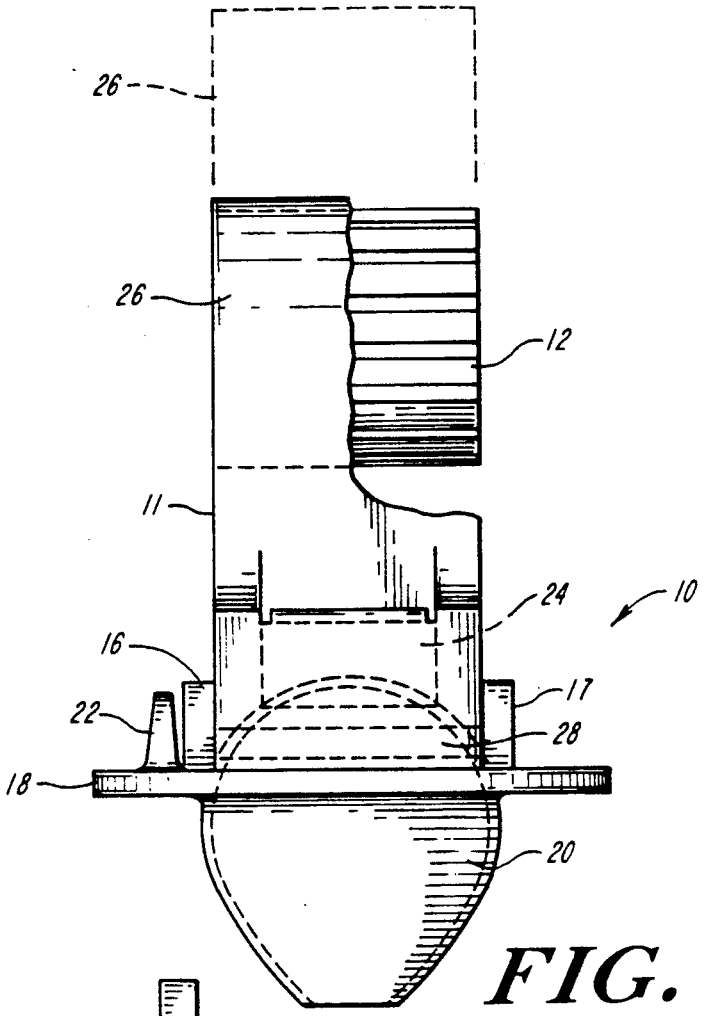
FIG. 3 is a front view of the flapper valve of FIG. 1.
Figure 5:
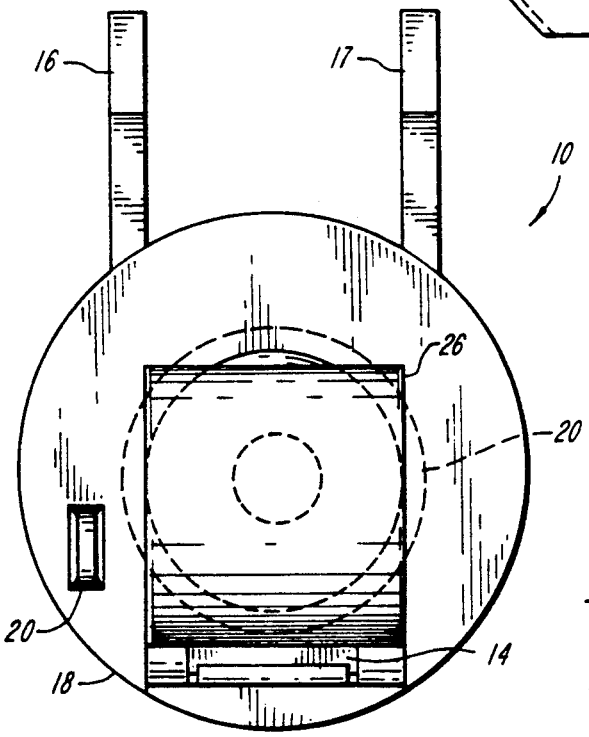
FIG. 5 is a top view of the flapper valve of FIG. 3.
Figure 6:
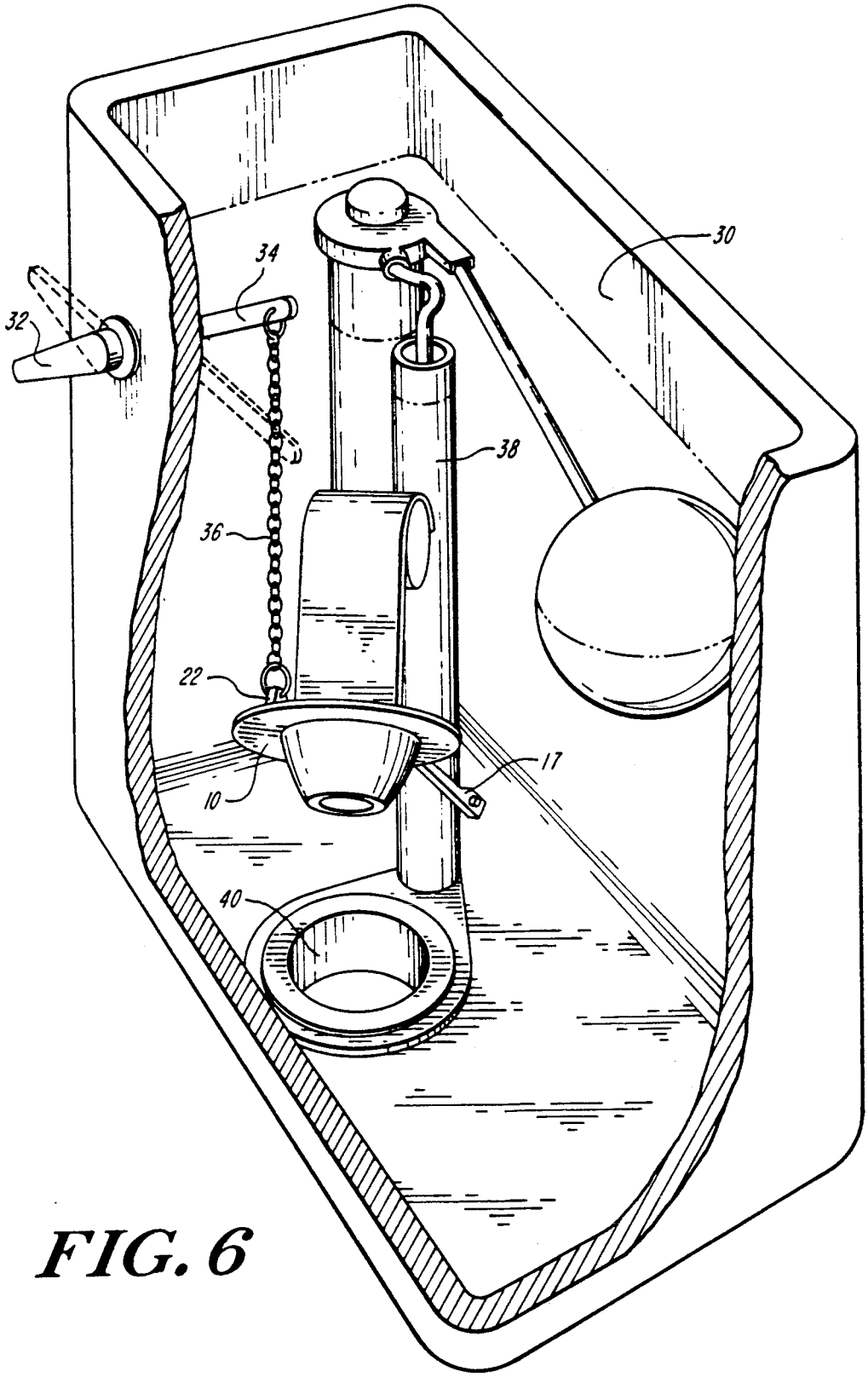
FIG. 6 is a cut-away view of a conventional holding tank showing the installation of the flapper valve of FIG. 1.

Referring to FIGS. 1, 2, 3, 4, 5 and 6 there is shown a preferred embodiment of the invention designated generally 10. The flapper valve 10 has a seat 18, a bulb 20, a mounting arm 16, a mounting arm 17, and an attach point 22.

A holding tank 30 includes a flush handle 32, a connecting rod 34, a chain 36, and an overflow tube 38, to which the flapper valve 10 is mounted. The flapper valve 10 is attached to the overflow tube 38 in a conventional manner by mounting arms 16 and 17. The chain 36 is attached to the attach point 22 of the flapper valve 10. Water exits the holding tank 30 through an outlet 40.

An extension 11 is mounted substantially perpendicularly to the seat 18. A slot 24 is formed in the extension 11. A weight 14 fits slidably into the slot 24. A float 12 is securely attached to an end 26 of the extension 11. The float 12 is further stabilized by engagement of secondary attach points in extension 11. The end 26 of the extension 11 may be rolled to position the float 12 at a selected distance from the seat 18.

The extension 11 has a thin flexible portion 28 sufficient to allow the extension 11 to rotate about this area.

The flapper valve assembly 10, which may also include extension 11, is formed out of one-piece plastic construction. The weight 14 is formed out of brass, or other material. The float 12 may be either solid (polystyrene or another similar material) or a sealed hollow vessel formed out of polyethylene or another similar material.

In another embodiment, the weight 14 is integrally formed as a fixed part of the extension 11.

When the flush handle 32 is operated in a conventional manner, namely a momentary rotation followed by a release of the handle, the present invention allows only a partial discharge of the water in the holding tank 30. As the flush handle 32 is rotated, the chain 36 attached to the valve 10 rotates the valve about its axis of attachment with the overflow tube 38. The float 12 rises upward and follows the surface of the water in the holding tank 30 as the water drains out from the holding tank 30. As the water level drops, the float 12 will compensate for the gravitational pull/closing effect of the weight 14 on the raised portion of the valve 10. As the water level continues to drop, the weighted valve 10 will drop at the same rate as the attached float 12. This controlled lowering of the valve 10 will continue until, at a partially-open position above the flush water outlet 40 of the tank 30, the water flowing around the valve 10 and exiting the tank 30 at the outlet 40, will force the valve 10 to close and seal, again submerging the float 12, before all the water has exited the holding tank 30.

The valve 10 may also be operated to obtain a complete flush using all or part of the water in the holding tank 30. This occurs if the flush handle 32 is rotated, and held, in its rotated position, until all or sufficient water in the holding tank 30 is discharged. B holding the flush handle 32 in its rotated position, the chain 36 overcomes the downward force of the weight 14, allowing the valve 10 to remain open until all the water in the holding tank 30, has been evacuated. Releasing the flush handle 32 at this time allows the valve 10 to close and water to be stored in the holding tank 30 for the next use.

The present invention can also be applied to vertical movement flush valves. In this case, the modified vertical movement flush valve would include a weight element and a spaced apart float element analogous to the embodiment just described.

Figure 7:
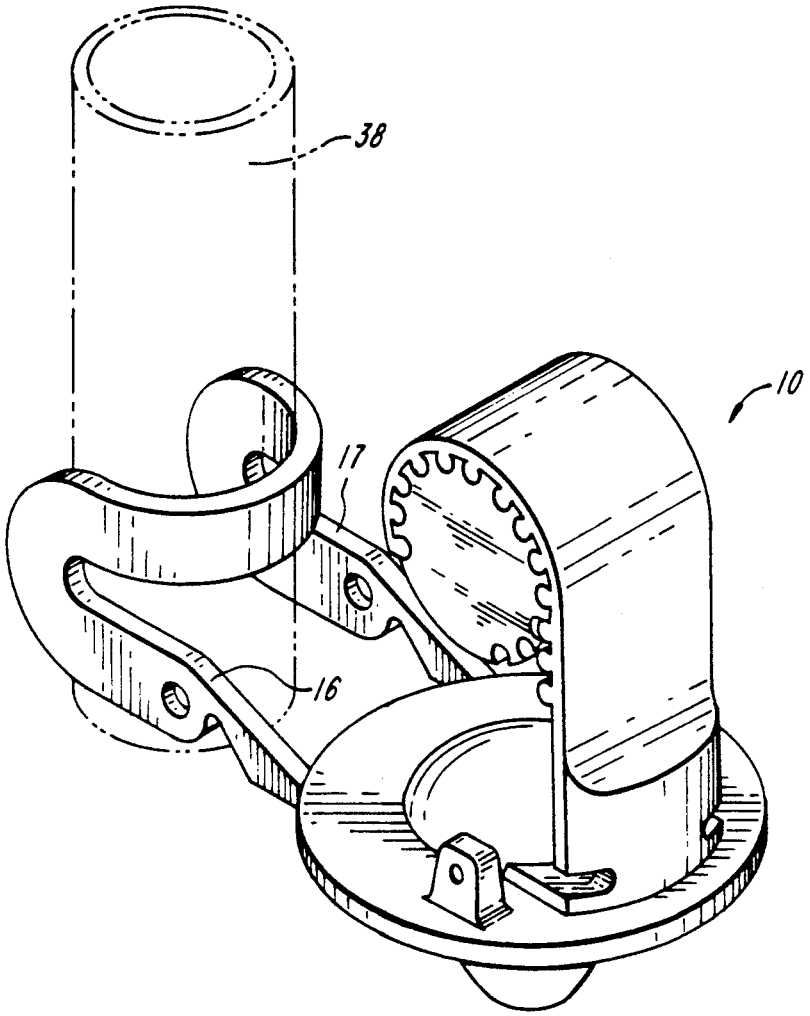
FIG. 7 is a perspective view of a further embodiment of the present invention.

Referring to FIG. 7 there is shown a further embodiment of the invention. The weight 14 and the slot 24 are eliminated. The mounting arms 16 and 17 are formed to provide a flexible mounting apparatus that imposes a closing moment upon the open flapper valve.

What is claimed is:

1. A modified valve for use with an outlet opening in a toilet tank comprising a conventional bulb having a flange disposed about an outside surface of the bulb or sealing engagement with a valve seat disposed about the outlet opening;

a flexible extension structure attached at a first end to the valve seat and extending substantially perpendicularly from the valve seat, the extension structure including a second end having at least one primary attachment point and a plurality of secondary attachment points, a float element removably attachable to the extension structure, the float element including a plurality of grooves for receiving the primary attachment point of the extension structure and at least one of the secondary attachment points of the extension structure;

wherein the number of secondary attachment points of the extension structure engaging the grooves of the float element determines the distance of the float element from the valve seat.

2. The modified valve of claim 1 where the valve is a flapper valve.

3. The modified valve of claim 1 where the valve is a vertical movement valve.

4. The modified valve of claim 1 further including a removably attached weight element, and the extension structure further including a slot for receiving the weight element, the slot located proximately at the first end of the extension structure.

5. The modified valve of claim 1 further including a weight element integral with the valve.

6. The modified valve of claim 1 wherein the first end of the extension structure includes a thin portion connected to the valve seat so as to allow the extension structure to rotate.

7. The modified valve of claim 1 further including a mounting apparatus for pivotally securing the valve within the toilet tank, wherein the mounting apparatus imposes a closing moment of the valve.

8. The modified valve of claim 7 wherein the mounting apparatus includes flexible arms.

* * * * *